United States Patent [19]

Booth

[11] 4,170,821

[45] Oct. 16, 1979

[54] RAZOR CARTRIDGES

[75] Inventor: Anthony R. Booth, Orange, Conn.

[73] Assignee: Warner-Lambert Company, Morris Plains, N.J.

[21] Appl. No.: 856,887

[22] Filed: Dec. 2, 1977

[51] Int. Cl.[2] ..... B26B 21/44

[52] U.S. Cl. ..... 30/41; 83/14

[58] Field of Search ..... 30/41, 90; 83/14, 22

[56] References Cited

U.S. PATENT DOCUMENTS

| | | | |
|---|---|---|---|
| 3,768,161 | 10/1973 | Miller | 30/41 |
| 3,811,349 | 5/1974 | Jennings | 83/14 |
| 3,956,951 | 5/1976 | Jennings | 83/14 |
| 3,969,817 | 7/1976 | DiBuono | 30/41 |
| 4,074,429 | 2/1978 | Roberts | 30/41 |

*Primary Examiner*—Jimmy C. Peters

*Attorney, Agent, or Firm*—Jeremiah J. Duggan; Stephen A. Schneeberger

[57] ABSTRACT

A solid water-soluble shaving aid incorporated in a disposable razor blade cartridge which gradually dissolves during the act of wet shaving. The shaving aid, in the form of a lubricant, whisker softener, razor cleaner, medicinal agent, cosmetic agent or combination of the above is embedded, dispersed into, formed as an integral component of, or otherwise affixed to the cartridge structure adjacent the shaving edge or edges of single or multiple blades supported therein.

15 Claims, 4 Drawing Figures

RAZOR CARTRIDGES

BACKGROUND OF THE INVENTION

1. Field of the Invention

Shaving equipment with particular reference to improvements in disposable razor cartridges.

2. Description of the Prior Art

A current shaving system includes a reusable razor main frame with handle which receives disposable blade cartridges. Spent cartridges are removed from the main frame and replaced by factory-fresh units.

In wet-shaving razor systems, there can be experienced a degree of uncomfortableness in shaving due to frictional drag of the razor across the skin, the force needed to sever and concomitantly the mechanical strength of the hair protein structure, clogging of the razor parts with whisker and skin debris and/or the uncomfortableness of shaving nicks and cuts, irritation or pre-existing skin damage or eruptions and uncontrolled bleeding.

Heretofore, various attempts to remedy at least some of these drawbacks have included the use of pre-shave and after-shave lotions, special whisker softening lathers, blood coagulants and other medicinal agents or soothing creams.

While shaving comfort can be enhanced, at least to some extent, with one or more of the above-mentioned aids, the requirement that they be applied before and/or after shaving with evaporation or repeated shaving strokes lessening the effectiveness of pre-applied aids and post-shaving application serving only as after-the-fact treatment, much is left to be desired in matters of improving shaving comfort.

Additionally, the awkwardness of transporting and individual handling required of multiple shaving aids, i.e., their individual containers, together with a continual need to separately replenish or tolerate unavailability at time of need, renders prior art approaches to the aforesaid problems much less than optimum.

It is with a view to improving present day wet shaving that the present invention provides for the application of a shaving aid directly to the skin continuously with each stroke of the razor, the shaving aid being a simple inexpensive integral part of a disposable razor blade cartridge which, itself, is disposable along with the cartridge when one or both are spent.

In addition to providing for direct application of the shaving aid with each stroke of the razor in shaving, it is an object of the invention to provide added convenience by unitizing the shaving aid and blade in a disposable cartridge system.

Other objects and advantages of the invention will become apparent hereinafter.

SUMMARY OF THE INVENTION

According to the invention, a shaving aid in the form of a lubricant, whisker softener, razor cleaner, medicinal agent, cosmetic agent or a combination of two or more of the above is affixed to a disposable razor cartridge containing one or more shaving blades.

The shaving aid is provided as a solid but water-soluble medium. It is embedded or dispersed into one or more of the blade-supporting components of the cartridge or used to form one of the components itself or outwardly attached to the cartridge structure in rod, strip or particle form. In all cases, the shaving aid is preferably, but not necessarily, located adjacent to shaving edges of the cartridge blade or blades. The invention is applicable to single or multiple-blade cartridges.

Upon wetting and stroking of the razor cutting edges over the skin, the shaving aid is applied directly to the affected area.

Details of the invention will become more readily apparent from the following description when taken in conjunction with the accompanying drawings.

IN THE DRAWINGS

FIG. 1 is a view, in perspective, of a razor cartridge incorporating an embodiment of the present invention and wherein, for ease and clarity of illustration, double cross-hatching has been used to depict portions of the razor cartridge which contain a solid but water-soluble shaving aid; and FIGS. 2, 3 and 4 are illustrations, in perspective, of modifications of the invention.

DESCRIPTION OF THE PREFERRED EMBODIMENTS

Figure 1:
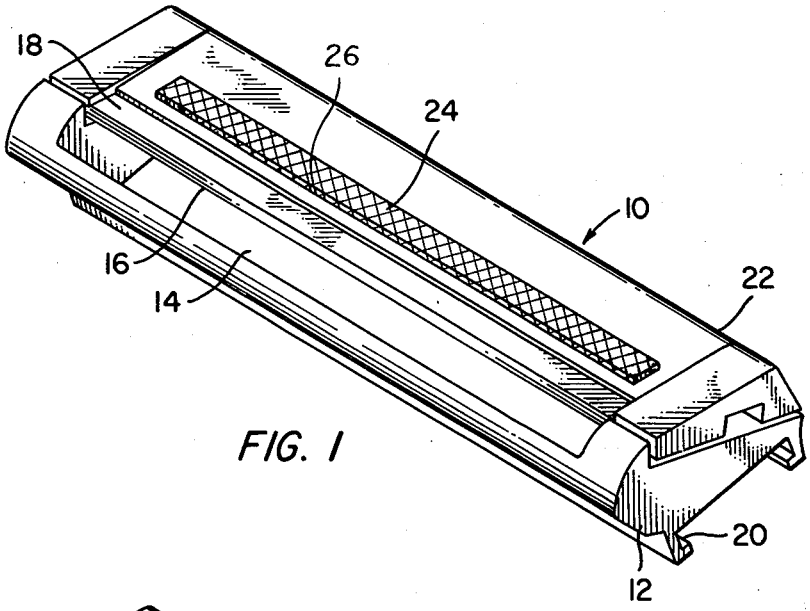

Razor cartridge 10 of FIG. 1 is typical of the type of shaving device to which the present invention is applicable in affording a solid but water-soluble shaving aid which is adapted to be applied directly to the skin continuously with each stroke of the razor during the act of wet shaving.

In conventional fashion, razor cartridge 10 comprises a blade seat 12 having formed thereon a guard bar 14 for smoothening the skin adjacent the cutting edge 16 of a razor blade 18 during shaving. Blade seat 12 further includes a channel 20 which may be used to load cartridge 10 upon a conventional reusable razor main frame (not shown) in the customary manner of sliding a receiving portion of the main frame into channel 20 or sliding channel 20 over the receiving portion of the razor main frame.

Completing the main supporting structure of razor cartridge 10 and holding blade 18 in place against seat 12 is cap 22. While cartridge 10 has been illustrated as being of the single-blade type, it should be understood that this structure is shown for purposes of illustration only and that the invention to be described in detail hereinafter is applicable not only to single-bladed cartridges but equally as well to multiple-bladed shaving cartridges.

The aforesaid basic components of cartridge 10 are fused, cemented or otherwise bonded together and hence have become well-known and commonly referred to in the trade as bonded razor blade cartridges.

In the embodiment of the invention illustrated in FIG. 1, a strip 24 formed of a solid but water-soluble shaving aid is cemented to cap 22 preferably within a recess 26 provided therefor. Shaving aid 24 is disposed in juxtaposition with edge 16 of blade 18 and extended from a point adjacent one end of the blade to a point similarly adjacent to the opposite end of the blade.

As used herein, the term "shaving aid" refers equally to either the shave-aiding agent combined with a solid, water-soluble micro-encapsulating or micro-porous structure which retains the agent or to that agent itself being a water-soluble solid.

Exemplary materials constituting shaving aid 24 may comprise one or various combinations of the following:

A. A lubricating agent for reducing the frictional forces between the razor and the skin, e.g., a microencapsulated silicone oil.

B. An agent which reduces the drag between the razor parts and the shaver's face, e.g., a polyethylene oxide in the range of molecular weights between 100,000 and 6,000,000; a non-ionic polyacrylamide; and/or a natural polysaccaride derived from plant materials such as "guar gum".

C. An agent which modifies the chemical structure of the hair to allow the razor blade to pass through the whiskers very easily, e.g., a depilatory agent is one example.

D. A cleaning agent which allows the whisker and skin debris to be washed more easily from the razor parts during shaving, e.g., a silicon polyethylene oxide block copolymer and detergent such as sodium larnyl sulphate.

E. A medicinal agent for killing bacteria, or repairing skin damage and abrasions.

F. A cosmetic agent for softening, smoothing, conditioning or improving the skin.

G. A blood coagulant for the suppression of bleeding that occurs from nicks and cuts.

As has been mentioned hereinabove, the configuration of shaving aid, its place of application to the razor cartridge, the manner of attachment and/or other means and method of incorporation may vary widely to fit particular requirements and, accordingly, modifications of the FIG. 1 embodiment of invention have been illustrated in FIGS. 2, 3 and 4.

Microencapsulation, though a relatively new technology, has been developed to the extent that it may be used to controllably release a large variety of agents including various oils such as silicone oil. Additional information concerning the technology of microencapsulation may be obtained from "Microencapsulation", pages 420–437 in "The Theory & Practice of Industrial Pharmacy", Second Edition, 1970, 1976, published by Lea & Febiger, which is incorporated herein by reference. Further, publication by Union Carbide Corporation of May 1977, entitled "Polyox, Water Soluble Resins: Forming Association Compounds" teaches, at page 11, the use of polyethylene oxide for microencapsulating water-immiscible oils and, at page 17, the use of gelatin and polyethylene oxide to form soluble films for microencapsulation applications, also included by reference.

Another Union Carbide Corporation publication of May 1972, entitled "Polyox, Water Soluble Resins: Thermoplastic Processing: Calendering, Extrusion, and Injection Molding", discloses a basic process for injection molding items using polyethylene oxide. That publication also describes the formation of calendered films and sheets of polyethylene.

U.S. Pat. Nos. 3,075,033 and 3,181,973 provide examples of ways in which polyethylene oxide may be mixed with an insoluble thermoplastic (such as polystyrene of which cap 22 and seat 12 herein are often made) and then formed into a plasticized mass. The polyethylene oxide is then released from the mass by the application of water.

The aforementioned "The Theory & Practice of Industrial Pharmacy", in Chapters 10 and 11 entitled "Compaction & Compression" and "Tablets," respectively, pages 296–358, discloses a variety of compression and/or compaction techniques which, with binders, may be used to form tablets or bars of a large variety of materials.

The foregoing discloses techniques by which shave-aiding agents, such as silicone oil, may be microencapsulated in water soluble capsules. Such microcapsules may then be mixed with a cement or binder and adhered to an appropriate surface of razor cartridge 10. Also disclosed are various techniques by which polyethylene oxide may be formed in a matrix with other materials, such as polystyrene, or formed into sheets or strips which may be adhered to an appropriate surface of razor cartridge 10.

These embodiments of the invention have been selected only to exemplify basic approaches to applying the shaving aid either in rod, strip or particle form. As it will become apparent, the shaving aid may be attached to an outer surface of a razor cartridge, recessed thereinto as in cartridge 10, formed as an integral part of one or more of the basiccartridge components (e.g. its guard bar or a spacer between blades in a twin-blade cartridge) and/or impregnated or dispersed in the material from which one or more of the blade-supporting cartridge components are molded or otherwise formed.

Figure 2:
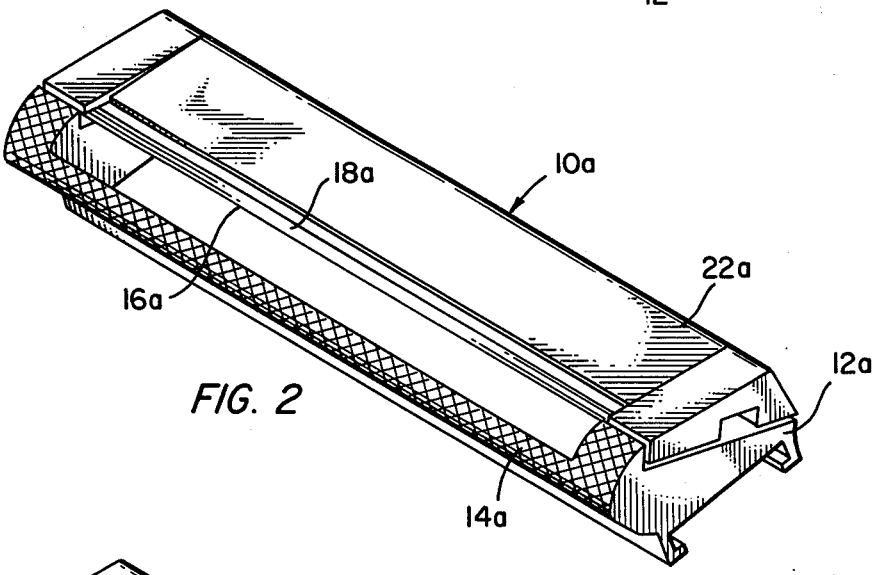
Figure 3:
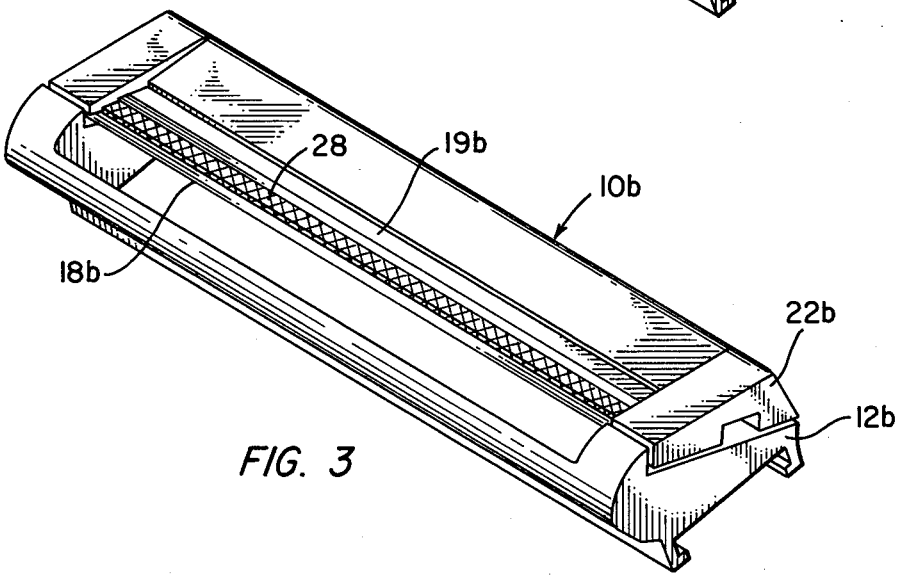

In FIG. 2, razor cartridge **10*a* is illustrated as comprising the usual blade seat 12*a* and cover 22*a* which holds blade 18*a* in place. In this case, however, guard bar 14*a* is formed as a separate component which is bonded to blade seat 12*a* and is itself comprised of one or a preselected combination of the aforementioned solid shaving aids. In this arrangement, guard bar 14*a* performs the dual function of smoothening the skin adjacent cutting edge 16*a* of razor blade 18*a*** and simultaneously applying, with each stroke of the razor, an amount of its water-soluble composition to the skin.

Razor cartridge **10*b* (FIG. 3) is illustrated as being of the twin-blade type wherein seat blade 18*b* is supported by blade seat 12*b* and cap blade 19*b* is supported upon spacer 28, the unit of blades and spacer being held in place by cap 22*b*. In this embodiment of the invention, it is contemplated that spacer 28 be formed of, or impregnated with, one or any preselected combination of the aforementioned shaving aids for the purpose of application to the face along with each stroke of razor cartridge 10*b*** thereacross.

Figure 4:
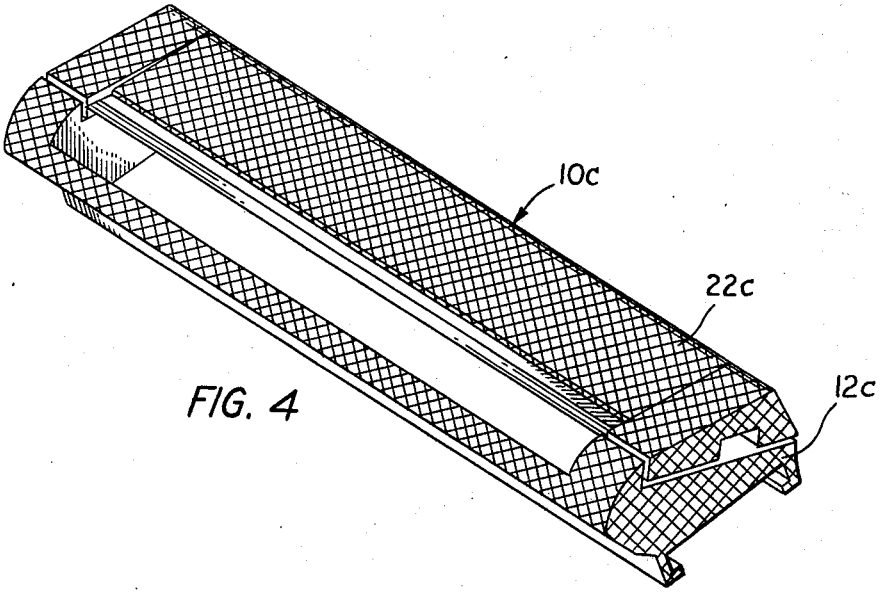

In FIG. 4, there is illustrated another single-bladed cartridge **10*c*, it being understood that this cartridge may be a twin-bladed system. In this embodiment of the invention, the two major components of razor cartridge 10*c*, namely blade seat 12*c* and cap 22*c*, are formed entirely of a solid shaving aid consisting of one or a preselected combination of the above exemplary compositions. Alternatively, blade seat 12*c* and cap 22*c* may be molded of a plastic material with one or more of the water-soluble shaving aids dispersed within the plastic, e.g. a dispersion of polyethylene oxide. Other forms of impregnation and/or surface treatment of components 12*c* and 22*c*** may be employed. It will be appreciated that the shaving aid is permanently and substantially immovably affixed to the razor cartridge in each of the foregoing embodiments.

In all cases, upon contact with the wet skin and/or by wetting of the razor cartridge, the shaving aid becomes immediately and repeatedly applied to the skin with each stroke of the razor thereover. Thus, its intended function is performed continuously throughout the shaving act as opposed to the heretofore requirement of pre-shave or after-shave treatment. The latter in particular provides only for correction or soothing of damage and/or uncomfortableness caused by shaving rather than taking the more desirable preventive measure contemplated by the invention.

Those skilled in the art will readily appreciate that there are various additional modifications and adaptations of the precise forms of the invention herein illustrated and, accordingly, it is intended that such modifications which incorporate the concept disclosed are to be construed as coming within the scope of the following claims or the range of equivalency to which they are entitled in the light of the prior art.

I claim:

1. A disposable razor cartridge comprising:

a blade seat;

a razor blade;

a cap; and an integral solid shaving aid, said shaving aid being permanently and substantially immovably affixed to said cartridge and being water soluble.

2. A razor cartridge according to claim 1 wherein said cartridge includes a second razor blade and a spacer between said blades.

3. A razor cartridge according to claim 1 wherein said shaving aid is in the form of a strip of said solid but water-soluble medium, said strip being in juxtaposition with said razor blade and affixed to one of said blade seat and cap components of said cartridge.

4. A razor cartridge according to claim 3 wherein said strip is at least partially recessed into said one of said cartridge components.

5. A razor cartridge according to claim 1 wherein said blade seat includes an integral guard bar portion and said shaving aid is incorporated in the structure of said guard bar portion.

6. A razor cartridge according to claim 5 wherein said guard bar is molded of a plastic material having said shaving aid dispersed within the said plastic material.

7. A razor cartridge according to claim 2 wherein said shaving aid is incorporated in at least a portion of said spacer.

8. A razor cartridge according to claim 2 wherein said blades have exposed parallel shaving edges and at least a portion of said spacer adjacent said shaving edges is constructed of said solid shaving aid.

9. A razor cartridge according to claim 1 wherein said blade seat and cap are impregnated with said shaving aid at least adjacent surfaces thereof normally contacting the skin during the act of shaving with said cartridge.

10. A razor cartridge according to claim 1 wherein said blade seat and cap are molded of a plastic material having said shaving aid dispersed within said plastic material.

11. A razor cartridge according to claim 1 wherein said integral solid shaving aid is a lubricant selected from the group consisting of micro-encapsulated silicone oil, polyethylene oxide in the range of molecular weights between 100,000 and 6,000,000, a non-ionic polyacrylamide and a natural polysaccaride derived from plant materials such as guar gum.

12. A razor cartridge according to claim 1 wherein the said integral solid shaving aid is a hair softening agent.

13. A razor cartridge according to claim 1 wherein the said integral solid shaving aid is a cleaning agent selected from the group consisting of silicone polyethylene oxide block copolymers and sodium larnyl sulphate.

14. A razor cartridge according to claim 1 wherein the said integral solid shaving aid is a medicinal agent.

15. A razor cartridge according to claim 1 wherein the said integral solid shaving aid is a blood coagulant.

* * * * *

US004170821B1

REEXAMINATION CERTIFICATE (1817th)

United States Patent [19]

Booth

[11] B1 4,170,821

[45] Certificate Issued Oct. 20, 1992

[54] RAZOR CARTRIDGES

[75] Inventor: Anthony R. Booth, Orange, Conn.

[73] Assignee: Warner-Lambert Company, Morris Plains, N.J.

Reexamination Request:
No. 90/002,410, Aug. 20, 1991

Reexamination Certificate for:

| | |
|---|---|
| Patent No.: | **4,170,821** |
| Issued: | **Oct. 16, 1979** |
| Appl. No.: | **856,887** |
| Filed: | **Dec. 2, 1977** |

[51] Int. Cl.[5] ..... B26B 21/44
[52] U.S. Cl. ..... 30/41; 83/14

[56] References Cited

U.S. PATENT DOCUMENTS

| | | | |
|---|---|---|---|
| 2,292,417 | 8/1942 | Wetherbee . | |
| 2,292,418 | 8/1942 | Wetherbee . | |
| 2,292,419 | 8/1942 | Wetherbee . | |
| 2,460,645 | 2/1949 | MacMicking . | |
| 3,786,563 | 1/1974 | Dorion et al. . | |
| 3,811,349 | 5/1974 | Jennings . | |
| 3,879,844 | 4/1975 | Griffiths | 30/47 X |
| 3,956,951 | 5/1976 | Jennings . | |

FOREIGN PATENT DOCUMENTS

| | | |
|---|---|---|
| 480565 | 7/1929 | Fed. Rep. of Germany . |
| 991064 | 7/1975 | Italy . |
| 49-1196 | 1/1974 | Japan . |
| 1157640 | 7/1969 | United Kingdom . |

OTHER PUBLICATIONS

"Microencapsulation", The Theory & Practice of Industrial Pharmacy, Second Edition, 1970, 1976, pp. 420–438, Lea & Febiger.

"Polyox, Water Soluble Resins: Forming Association Compounds", Union Carbide Corporation, May 1977, pp. 1–3, 11, 17.

"Polyox, Water Soluble Resins: Thermoplastic Processing: Calendering, Extrusion, and Injection Molding", Union Carbide Corporation, May 1972, pp. 1–4.

"Compaction & Compression" and Tablets, The Theory & Practice of Industrial Pharmacy, Second Edition 1970, 1976, Chapters 10 and 11, respectively, pp. 296–358, Lea & Febiger.

*Primary Examiner*—Douglas D. Watts

[57] ABSTRACT

A solid water-soluble shaving aid incorporated in a disposable razor blade cartridge which gradually dissolves during the act of wet shaving. The shaving aid, in the form of a lubricant, whisker softener, razor cleaner, medicinal agent, cosmetic agent or combination of the above is embedded, dispersed into, formed as an integral component of, or otherwise affixed to the cartridge structure adjacent the shaving edge or edges of single or multiple blades supported therein.

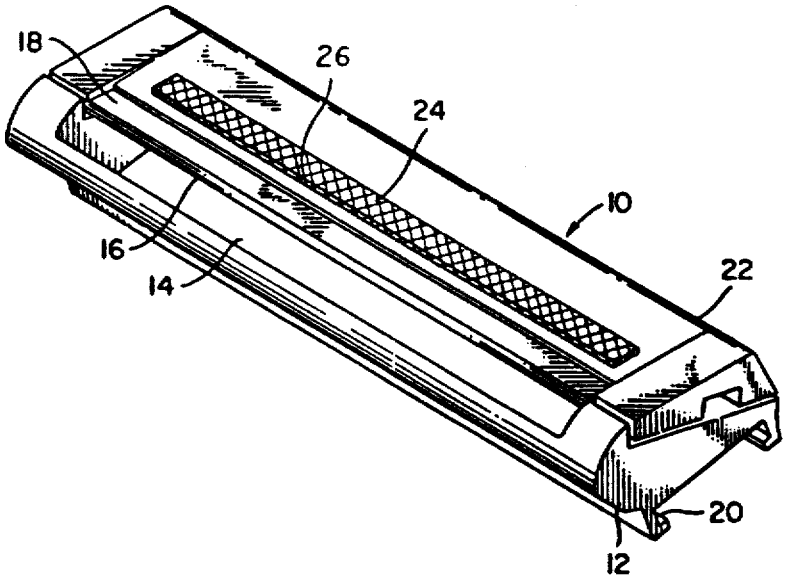

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1-15 is confirmed.

* * * * *